US006237762B1

(12) United States Patent
Faircloth

(10) Patent No.: US 6,237,762 B1
(45) Date of Patent: May 29, 2001

(54) GARMENT PACKAGE WITH FOLDABLE FLAPS AND DOWNWARDLY EXTENDING GARMENT COVERING TAB

(75) Inventor: Michael Faircloth, Winston-Salem, NC (US)

(73) Assignee: Sara Lee Corporation

( * ) Notice: Subject to any disclaimer, the term of this patent is extended or adjusted under 35 U.S.C. 154(b) by 0 days.

(21) Appl. No.: 09/469,115

(22) Filed: Dec. 21, 1999

(51) Int. Cl.[7] ..... B65D 85/18
(52) U.S. Cl. ..... 206/299; 206/297
(58) Field of Search ..... 206/281, 288, 206/297, 299, 461, 806; D9/433

(56) References Cited

U.S. PATENT DOCUMENTS

D. 421,568 * 3/2000 Ferguson et al. ..... D9/414
3,794,793 * 2/1974 Rius ..... 206/299
4,014,436 * 3/1977 Tunis ..... 206/299
4,190,151 * 2/1980 Russell ..... 206/281
4,257,522 * 3/1981 Thorneburg ..... 206/299
5,469,959 * 11/1995 Gummer ..... 206/299

* cited by examiner

*Primary Examiner*—David T. Fidei
(74) *Attorney, Agent, or Firm*—Charles Y. Lackey; Kilpatrick Stockton LLP

(57) ABSTRACT

A package for housing and protecting a folded garment has a back and two front foldable flaps. Each front foldable flap has two foldable sections, and each section has a partial side. A top extends partially along the back, covers the upper edge of the folded garment and is formed into a downwardly extending tab positioned between the folded garment and the front foldable flaps.

20 Claims, 1 Drawing Sheet

GARMENT PACKAGE WITH FOLDABLE FLAPS AND DOWNWARDLY EXTENDING GARMENT COVERING TAB

BACKGROUND OF THE INVENTION

1. Field of the Invention

The present invention is a garment package and more particularly a garment package for housing and protecting a folded garment having foldable front flaps and a depending and protective top.

2. Description of the Prior Art

Packaging for folded and displayed garments, such as socks and other hosiery products, normally consist of an insert or an inner support means of some description and a band holding the folded garment against the support means so that the fabric of the garment can be seen and touched by the shopper. Since it is an encouragement to the shopper to feel the fabric of the garment, often the garment is removed from the band and support member and thereafter unfolded for a more complete study. In the majority of cases, the shopper is not inclined to take the time and effort to refold carefully the garment and reposition it on the support member and within the band. Thus, the band, support member and garment are usually casually laid back on the display likely in an unhung and rather unattractive condition making it very unlikely to be viewed by subsequent shoppers. Frequent maintenance of such displays is therefore required in order to replace the unwrapped garment with a new package or at least refold and reposition the garment on the supporting member and within the band.

Other prior art devices involve the use of more than one surrounding band in an effort to secure the garment more rigidly to the support member and resist removal of the garment from the member by the shopper. In that style package, one band encircles the two folded leg members of the garment and the second band then encompasses the entire garment when a fold is made over the first band with a section of the folded leg. This package is somewhat more effective in resisting removal of the package from the backing; however, it is still exposed and has a tendency to collect dust and other debris that might be in close proximity to the display. While it does require some effort to remove the garment for additional inspection from the two bands and backing member, this activity frequently takes place with the same result as previously described. The package and garment must be replaced, or at the least, the garment must be refolded and repositioned into the existing package if both articles are undamaged.

There is no relatively inexpensive and cooperatively designed package that will secure the garment within the package surrounding, protect the garment from dust and other debris to which it may be exposed, and minimize the maintenance required in refurbishing and repackaging folded displayed products such as socks and hosiery. Since these requirements are critical to the successful and ongoing display of products of this nature, it is to these desirable features that the present invention is directed.

OBJECTIVES AND SUMMARY OF THE INVENTION

A primary objective of the present invention is to provide a package for a folded garment that has all of the advantages of prior art packages and more, and none of the disadvantages.

Another objective of the present invention is to provide a package of the type described which will protect the folded and displayed article from dust or debris and from otherwise being spoiled by the touch of a prospective customer.

Yet another objective of the present invention is to provide a package of the type described that will resist to a great degree the removal of the garment from the structure of the package for a more intimate examination by the prospective customer.

Still another objective of the present invention is to provide a package of the type described which will permit the garment to be hung on a display or otherwise attractively presented.

Yet still another objective of the present invention is to provide a packaged garment that will resist tampering and garment removal and thereby minimize maintenance time and replacement costs associated with conventional packaging of this nature.

The package of the present invention includes a back, first and second foldable front flaps each having first and second foldable sections. Each foldable section of each foldable flap forms a partial side for the package protecting the housed garment along these sides from touch or removal. A top has a first portion proximate the back and a second portion having a garment covering area and a depending tab positionable between the folded garment and the closed first and second foldable flaps to shield the garment from dust and debris and resist removal of the garment from the package.

Thus, there has been outlined, rather broadly, the more important features of the invention in order that the detailed description that follows may be better understood and in order that the present contribution to the art may be better appreciated. There are, obviously, additional features of the invention that will be described hereinafter which will form the subject matter of the claims appended hereto. In this respect, the invention in detail, it is to be understood that the invention is not limited in its application to the details and construction and to the arrangement of the components set forth in the following description or illustrated in the drawings. The invention is capable of other embodiments and of being practiced and carried out in several ways.

It is also to be understood that the phraseology and terminology used herein are for the purpose of description and should not be regarded as limiting in any respect. Those skilled in the art will appreciate the concept upon which this disclosure is based and that it may readily be utilized as a basis for designing other structures, methods and systems for carrying out the several purposes of the invention. It is also to be understood that the abstract is neither intended to define the invention of the application, which is measured by its claims, nor to limit its scope in any way.

This summary and these objectives of the invention, along with the various features of novelty which characterize the invention, are pointed out with particularity in the claims annexed to and forming a part of this disclosure. For a better understanding of the invention, its operating advantages, and the specific objects obtained by its use, reference should be made to the accompanying drawings and descriptive matter in which like characters of reference designate like parts throughout the several views.

DETAILED DESCRIPTION OF THE PREFERRED EMBODIMENT

Figure 1:
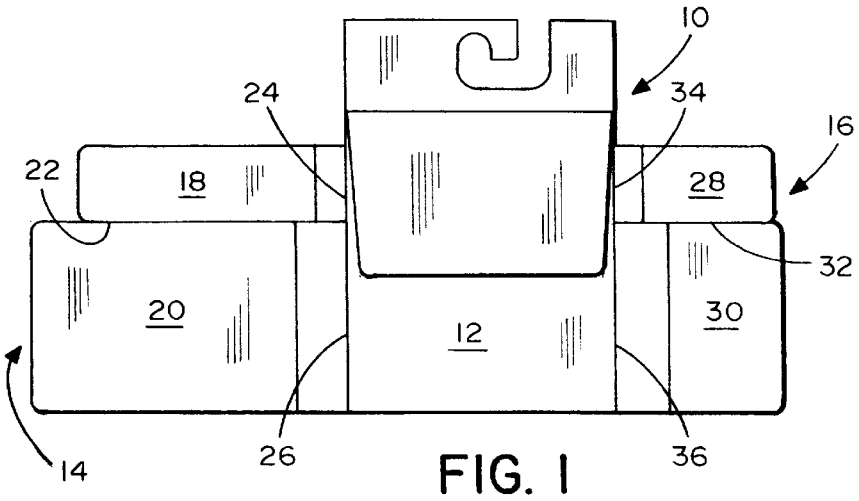
FIG. 1 is a front elevational view of the package comprising the present invention showing the foldable front flaps in the open condition.
Figure 2:
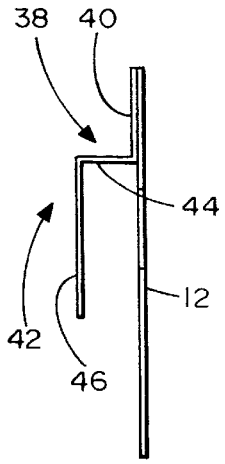
FIG. 2 is a side elevational view of the open and emptied package of FIG. 1.

Referring now to the drawings and particularly to FIG. 1, an open and empty garment package is shown generally as 10 and includes a back 12, a first foldable front flap 14 and a second foldable front flap 16. First foldable front flap 14 has first and second sections 18, 20 separated by a slit 22 so that section 18 is hingedly connected to back 12 along line 24 and section 20 is hingedly connected to back 12 along line 26. Similarly, flap 16 is divided into two sections 28, 30 which are separated at slit 32. Section 28 is hingedly connected to back 12 along line 34, and section 30 is hingedly connected to back 12 along line 36.

Figure 3:
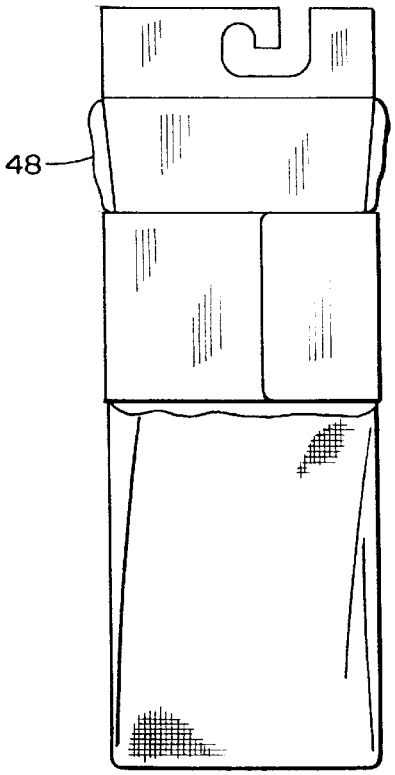
FIG. 3 is a front elevational view of the package of FIG. 1 supporting a folded leg garment with the foldable front flaps in the closed or garment encircling condition.
Figure 4:
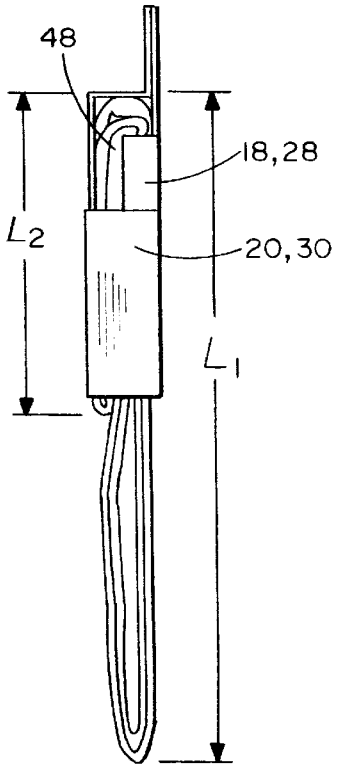
FIG. 4 is a side elevational view of the package and garment shown in FIG. 3.

A top shown generally as 38 includes a first portion 40 which is contiguous with back 12 and a second portion 42 which includes a garment covering area 44 and a depending tab 46 which is positioned between foldable flaps 20, 30 and folded garment 48. Thus area 44 of top 38 extends over and covers the folded product 48 so that product 48 is shielded from the accumulation of dust or other debris. Tab 46 of top 38 extends downwardly as shown in FIG. 4 and becomes encircled and secured within the band formed by sections 20 and 30 when they are in the closed position as shown in FIGS. 3 and 4. A small amount of glue (not shown) can be positioned on the surface of tab 46 or sections 20, 30 so that tab 46 bonds with sections 20, 30 when they are in the closed position and thus resist removal therefrom by a shopper.

When garment 48 is placed within package 10 in a preliminary folded condition, it is longer than the packaged garment shown in FIG. 3. The length of the garment in that folded condition is the sum of the distances L1 and L2 shown in FIG. 4. The fold is over first foldable sections 18, 28 and encircles the garment in the first folded condition as shown in FIG. 4. Garment length L2 is then folded over joined foldable sections 18, 28 at which time sections 20, 30 are positioned to totally encircle the garment and tab 46 in the second or final fold position.

Thus, an embodiment of the package for maintaining and protecting a garment in a folded condition has been illustrated and described in operable form. It is to be realized that optimum dimensional relationships for the parts of the invention to include variations in size, materials, shape, form, function and manner of operation, assembly and use are deemed readily apparent and obvious to one skilled in the art. All equivalent relationships to those illustrated in the drawings and described in the specification are intended to be encompassed herein. The foregoing is considered as illustrative only of the principles of the invention. Numerous modifications and changes will readily occur to those skilled in the art, and it is not desired to limit the invention to the exact construction and operation shown and described. All suitable modifications and equivalents that fall within the scope of the appended claims are deemed within the present inventive concept.

What is claimed is:

1. A package for maintaining and protecting a garment in a folded condition comprising:

a back having opposing sides;

a first foldable front flap having first and second foldable sections, each of the foldable sections of the first foldable front flap foldably connected to one side of the back;

a second foldable front flap having first and second foldable sections, each of the foldable sections of the second foldable front flap foldably connected to the opposing side of the back; and a top having a first portion proximate the back and a second portion having a garment covering area substantially perpendicular to the top first portion and a depending tab adjacent to foldable front flaps.

2. The package as claimed in claim 1 wherein the first foldable front flap has a first foldable section and a second foldable section, and the second foldable front flap has a first foldable section and a second foldable section.

3. The package as claimed in claim 2 wherein the first front foldable flap first foldable section forms a first package partial side and the first front foldable flap second foldable section forms a second package partial side, the first and second partial sides having different thicknesses.

4. The package as claimed in claim 3 wherein the second front foldable flap first foldable section forms a third package partial side and the second front foldable flap second foldable section forms a fourth package partial side, the third and fourth partial sides having different thicknesses.

5. The package as claimed in claim 4 wherein the top depending tab is nested between the garment and the first and second front foldable flaps to shield and resist removal of the garment from the package.

6. The package as claimed in claim 1 wherein the top depending tab is nested between the garment and the first and second front foldable flaps to shield and resist removal of the garment from the package.

7. The package as claimed in 1 wherein the top depending tab is nested between the garment and the first and second front foldable flaps to shield and resist removal of the garment from the package.

8. The package as claimed in claim 2 wherein the first front foldable flap first foldable section forms a first package partial side and the second front foldable flap second foldable section forms a second package partial side, the first and second partial sides having different thicknesses.

9. The package as claimed in claim 2 wherein the top depending tab is nested between the garment and the first and second front foldable flaps to shield and resist removal of the garment from the package.

10. The package as claimed in claim 4 wherein the first foldable section of each of the first and second foldable front flaps is substantially equal.

11. The package as claimed in claim 4 wherein the second foldable section of each of the first and second front foldable flaps is substantially equal.

12. The package as claimed in claim 10 wherein the first foldable front flap first foldable section and the second front foldable flap first foldable section are adapted to overlap in a closed position to shield and resist removal of the garment from the package.

13. The package as claimed in claim 11 wherein the first foldable front flap second foldable section and the second front foldable flap second foldable section are adapted to overlap in a closed position to shield and resist removal of the garment from the package.

14. The package as claimed in claim 4 wherein the first and third package partial sides have the same thickness and the second and fourth package partial sides have the same thickness.

15. The package as claimed in claim 14 wherein the first and third package partial side thickness is approximately half the second and fourth package partial side thickness.

16. The package as claimed in claim 1 wherein the top first portion and an area on the back corresponding to the top first portion further comprise a cutout tab to facilitate hanging the package.

17. The package as claimed in claim 4 wherein the top first portion and an area on the back corresponding to the top first portion further comprise a cutout tab to facilitate hanging the package.

18. The package as claimed in claim 14 wherein the top first portion and an area on the back corresponding to the top first portion further comprise a cutout tab to facilitate hanging the package.

19. The package as claimed in claim 14 wherein the top depending tab is nested between the garment and the first and second front foldable flaps to shield and resist removal of the garment from the package.

20. A package for maintaining and protecting a garment in a folded condition comprising:

a back having opposing sides;

a first foldable front flap having first and second foldable sections, each of the foldable sections of the first foldable front flap foldably connected to one side of the back;

a second foldable front flap having first and second foldable sections, each of the foldable sections of the second foldable front flap foldably connected to the opposing side of the back; and a top having a first portion proximate the back and a second portion having a garment covering area substantially perpendicular to the top first portion and a depending tab adjacent to foldable front flaps;

wherein the top first portion and an area on the back corresponding to the top first portion further comprise a cutout tab to facilitate hanging the package;

wherein the first foldable front flap first foldable section forms a first package partial side and the first front foldable flap second foldable section forms a second package partial side, the first and second partial sides having different thicknesses;

wherein the second front foldable flap first foldable section forms a third package partial side and the second front foldable flap second foldable section forms a fourth package partial side, the third and fourth partial sides having different thicknesses;

wherein the first and third package partial sides have the same thickness and the second and fourth package partial sides have the same thickness, and the first and third package partial side thickness is approximately half the second and fourth package partial side thickness;

wherein the first foldable front flap first foldable section and the second front foldable flap first foldable section are adapted to overlap in a closed position and the first foldable front flap second foldable section and the second front foldable flap second foldable section are adapted to overlap in a closed position; and wherein the top depending tab is nested between the garment and the first and second front foldable flaps to shield and resist removal of the garment from the package.

* * * * *